US007271690B2

(12) United States Patent
Bushnell

(10) Patent No.: US 7,271,690 B2
(45) Date of Patent: Sep. 18, 2007

(54) HIGH CURRENT LONG LIFE INDUCTOR

(75) Inventor: Andrew Hugh Bushnell, San Diego, CA (US)

(73) Assignee: General Atomics Electronic Systems, Inc., San Diego, CA (US)

( * ) Notice: Subject to any disclaimer, the term of this patent is extended or adjusted under 35 U.S.C. 154(b) by 0 days.

(21) Appl. No.: 11/293,952

(22) Filed: Dec. 5, 2005

(65) Prior Publication Data

US 2006/0080829 A1 Apr. 20, 2006

Related U.S. Application Data

(62) Division of application No. 10/728,075, filed on Dec. 4, 2003, now Pat. No. 7,005,954.

(51) Int. Cl.
*H01F 27/02* (2006.01)

(52) U.S. Cl. ..... 336/83; 336/198; 29/602.1

(58) Field of Classification Search ..... 336/83
See application file for complete search history.

(56) References Cited

U.S. PATENT DOCUMENTS

| | | | | |
|---|---|---|---|---|
| 2,591,408 | A * | 4/1952 | Crankshaw | 55/431 |
| 3,243,746 | A * | 3/1966 | Doggart et al. | 336/92 |
| 3,353,040 | A * | 11/1967 | Abbott | 310/27 |
| 6,842,101 | B2 * | 1/2005 | Maguire et al. | 336/198 |

* cited by examiner

*Primary Examiner*—Elvin Enad
*Assistant Examiner*—Joselito Baisa
(74) *Attorney, Agent, or Firm*—Nydegger & Associates

(57) ABSTRACT

An inductor for high current applications includes a non-conductive, tubular form which defines a tube axis and has a cylindrical outer surface. The outer surface is formed with a groove that extends helically about the tube axis. The inductor further includes a coiled, conductive wire that is formed with a plurality of turns. The wire is wound around the outer surface of the form with at least a portion of the wire disposed in the groove. With this structure, the form maintains a predetermined separation between adjacent turns of the coil preventing deformation of the coiled wire by strong magnetic forces that are generated when relatively high electrical currents are passed through the wire.

15 Claims, 3 Drawing Sheets

HIGH CURRENT LONG LIFE INDUCTOR

This application is a divisional of application Ser. No. 10/728,075, filed Dec. 4, 2003 now U.S. Pat No. 7,005,954, which is currently pending. The contents of application Ser. No. 10/728,075 are incorporated herein by reference.

FIELD OF THE INVENTION

The present invention pertains generally to inductors. More particularly, the present invention pertains to inductors designed for repetitively pulsed, high current applications. The present invention is particularly, but not exclusively, useful as an inductance coil for high current applications in which a relatively long service life is required.

BACKGROUND OF THE INVENTION

Inductance coils are commonly used in various electrical, electronic and electromechanical applications. It is well known that the electrical characteristics of an inductance coil are dependent on the size and shape (e.g. the number of coil turns) of the coil, as well as a number of other factors. In practice, inductance coils are designed with a particular purpose in mind, and as a consequence, it is a basic design requirement that an inductance coil maintain its original electrical characteristics during its service life. This, in turn, implies that the inductance coil maintain its original shape (i.e. does not deform or fracture in service).

In use, inductance coils generate magnetic fields which are proportional in strength to the current that is passed through the coil. These magnetic fields, in turn, generate magnetic forces, the strength of which are proportional to the square of the magnitude of the magnetic fields. When relatively high currents are passed through single layer inductance coils, strong magnetic forces are generated that can deform the coil.

During high current flow, wires in single layer solenoid inductors are exposed to significant magnetic forces. Relative to a circular coil, these forces comprise or include two primary components. The first component is oriented perpendicular to the axis of the coil and produces a hoop stress in the wire. This hoop stress results from the magnetic pressure that is generated by the relatively high field inside the coil and the relatively low field outside the coil. In addition, there is a "turn to turn" force on the wires that causes the wires next to each other to be pulled together. This "turn to turn" force is most pronounced on the ends of the coil and causes the wires on the end of the coil to try to move toward the center of the coil. The forces balance near the center of the inductor and these axial forces are less of a concern at the center of the coil. On the other hand, because the forces are strong near the coil ends, the termination of the coil ends must withstand relatively strong forces.

The above-described axial forces can also cause unrestrained cyclic deformations (which are typically more pronounced when pulsed currents are used) that can lead to fatigue failure and result in a relatively short inductor service life. In addition, another factor that must be considered is the heating (i.e. ohmic heating) that occurs during current flow through the inductor. Prior art devices in which the coil is completely embedded in a dielectric structure (e.g. fiberglass) are prone to overheating. Overheating of the inductance coil can alter the electrical characteristics of an inductance coil and decrease fatigue cycles to failure. Although the problem of overheating may be overcome by using a hollow, tubular conductor as an inductor coil and passing a cooling fluid therethrough, this solution is overly complicated and typically requires cooling lines, pumps and controllers.

In light of the above, it is an object of the present invention to provide an inductor that has a relatively long service life when used with relatively high currents that are repetitively pulsed. It is another object of the present invention to provide a high pulsed current inductor which maintains a suitable service temperature and does not overheat in use. Yet another object of the present invention is to provide a high pulsed current inductor and a method for manufacturing a high pulsed current inductor which are easy to use, relatively simple to implement, and comparatively cost effective.

SUMMARY OF THE INVENTION

The present invention is directed to an inductor for use in applications in which a relatively high current is passed through the inductor. In some applications, a repetitively pulsed, high current is passed through the inductor. For the present invention, the inductor includes a nonconductive, tubular form which is typically made of a glass—epoxy composite material. Within this tubular shape, the form defines a tube axis and has an outer surface which is typically cylindrically shaped. For the inductor envisioned by the present invention, the outer surface is formed with a groove that extends substantially helically about the tube axis.

For the present invention, the inductor also includes a coiled, conductive wire that is formed with a plurality of turns. The wire is wound around the outer surface of the form with at least a portion of the wire disposed in the groove. With this interactive cooperation of structure, the form maintains a predetermined separation between adjacent turns of the coil. More specifically, the form prevents deformation of the coil wire by the strong magnetic forces that are generated when high electrical currents are passed through the wire.

In another aspect of the present invention, a mechanism is provided to clamp the ends of the wire to the form. More specifically, the ends of the wire are clamped into a conductive terminal (e.g. copper) with stainless steel clamps that are positioned outside the tubular form where the magnetic fields generated by the high currents are relatively low. The conductive terminal, in turn, includes provisions for electrical connections to bus bars which connect to other circuit elements.

Structurally, the inductor can include a pair of saddles that are made of a nonmagnetic material such as stainless steel. For the inductor of the present invention, a saddle is positioned at each end of the form. Each saddle includes an inner saddle member that is located inside the form, and is positioned against the inner surface of the tubular form. In addition, each saddle includes an outer saddle member that is located outside the form, and is positioned against the outer surface of the tubular form. A fastening system (e.g. one or more high strength stainless steel bolts) is provided for each saddle that extends through the tubular form to attach the inner saddle member to the outer saddle member. Each conductive clamp, between the inductor and the conductive terminal, is then mounted on a respective outer saddle member. This cooperation of structure allows only high strength, nonmagnetic portions of the saddle/clamp system to be located within the tubular form where relatively strong magnetic fields are generated.

In a particular embodiment of the present invention, the inductor is designed to be mounted on a flat mounting plate together with various other components. For this purpose, the inductor can include a pair of insulating members, with each insulating member affixed to a respective outer saddle member. Each insulating member, in turn, is attached to the mounting plate. In another aspect of the present invention, a shroud can be mounted on the mounting plate and used to partially cover the form and coil wire. A fan is then activated to pass air through a volume defined by the shroud to cool the partially exposed wire.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
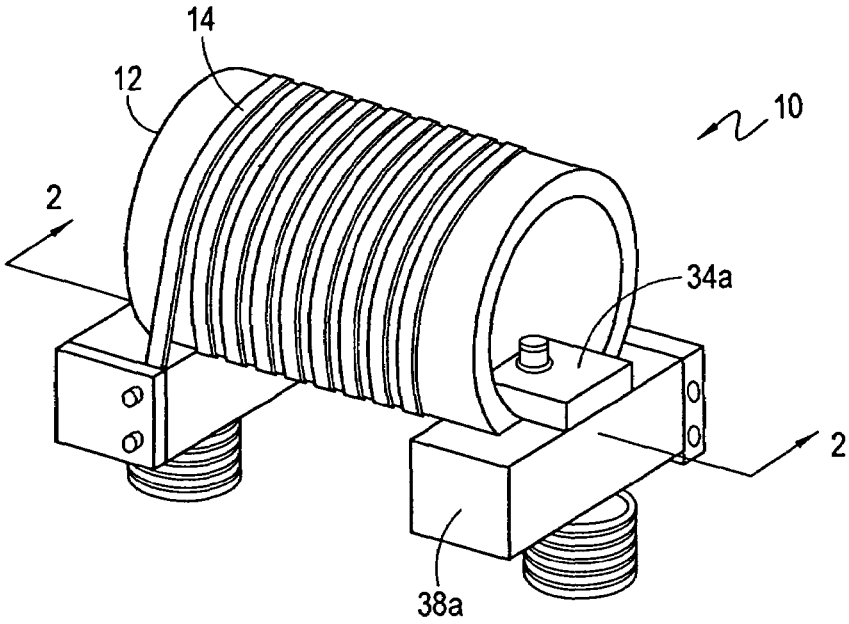
FIG. 1 is a perspective view of an inductor.

Referring to FIG. 1, an inductor is shown and generally designated 10. As illustrated in FIG. 1, the inductor 10 includes a form 12 and a conductive wire coil 14. For the inductor 10 shown in FIG. 1, the wire coil 14 has been designed to pass a 50 kA current for millisecond pulses and provide an insulation for up to 3500 volts across the coil 14. The coil 14 is designed to have an inductance of about 5 μH. Although the inductor 10 shown in FIG. 1 is capable of performing at the above specified current parameters, it is to be appreciated that the present invention is not limited to these parameters, but instead can be used with currents having other magnitudes and pulse durations.

Figure 2:
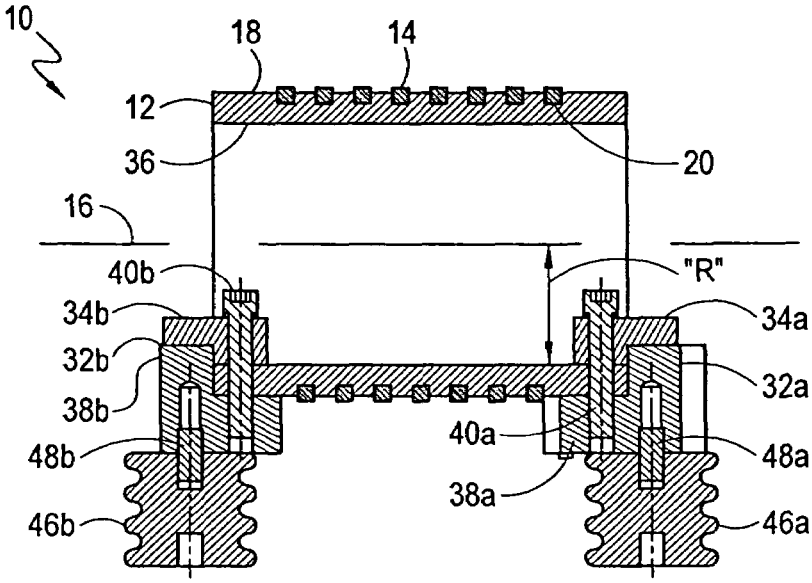
FIG. 2 is a cross-sectional view of an inductor as seen along line 2-2 in FIG. 1.

A more detailed understanding of the form 12 used in the inductor 10 can be obtained with cross-reference to FIGS. 1 and 2. As seen there, the form 12 is tubular shaped defining a tube axis 16 and has an outer surface 18 which is typically cylindrically shaped. For the inductor 10, the form 12 is preferably made of a nonconductive (i.e. dielectric) material such as a relatively strong, heat resistant, glass—epoxy composite material. For example, a suitable material is FR4, which is a commercially available, glass—epoxy composite. As best seen in FIG. 2, the outer surface 18 of the form 12 is formed with a groove 20 that extends substantially helically about the tube axis 16. As further shown, for the inductor 10 shown, the groove 20 has been formed with a rectangular cross-section.

Continuing with cross-reference to FIGS. 1 and 2, it can be seen that the wire coil 14 includes a plurality of turns (approximately 7 turns for the embodiment shown) and is wound around the outer surface 18 of the form 12. From FIG. 2 it can be seen that the wire coil 14 has a generally rectangular or square cross-section and a portion of the wire coil 14 is disposed in the groove 20. As further shown, portions of the wire coil 14 extend radially from the groove 20 exposing a portion of the wire coil 14 for interaction with a volume surrounding the inductor 10. As explained in greater detail below, a fluid (e.g. air) can be circulated through the volume surrounding the inductor 10 to cool the wire coil 14 and form 12.

With the wire coil 14 disposed in the groove 20 as shown in FIGS. 1 and 2, the form 12 maintains the initial separation between adjacent turns of the coil 14. More specifically, the form 12 prevents deformation of the wire coil 14 by the strong magnetic forces that are generated when high electrical currents are passed through the wire coil 14. As indicated above, cyclic coil deformation can lead to inductor failure due to fatigue fracture.

Figure 3:
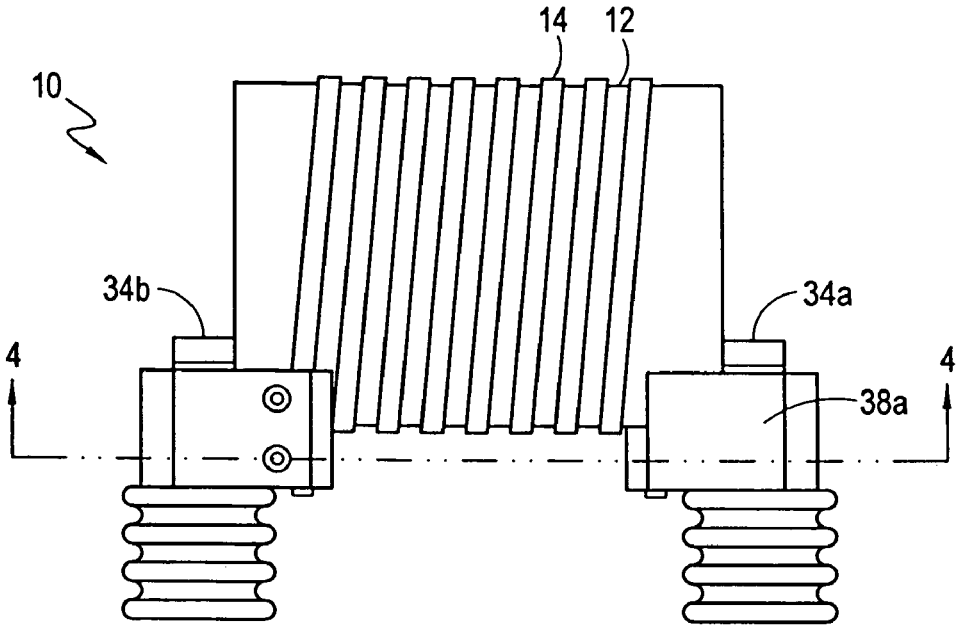
FIG. 3 is a front plan view of the inductor shown in FIG. 1.
Figure 4:
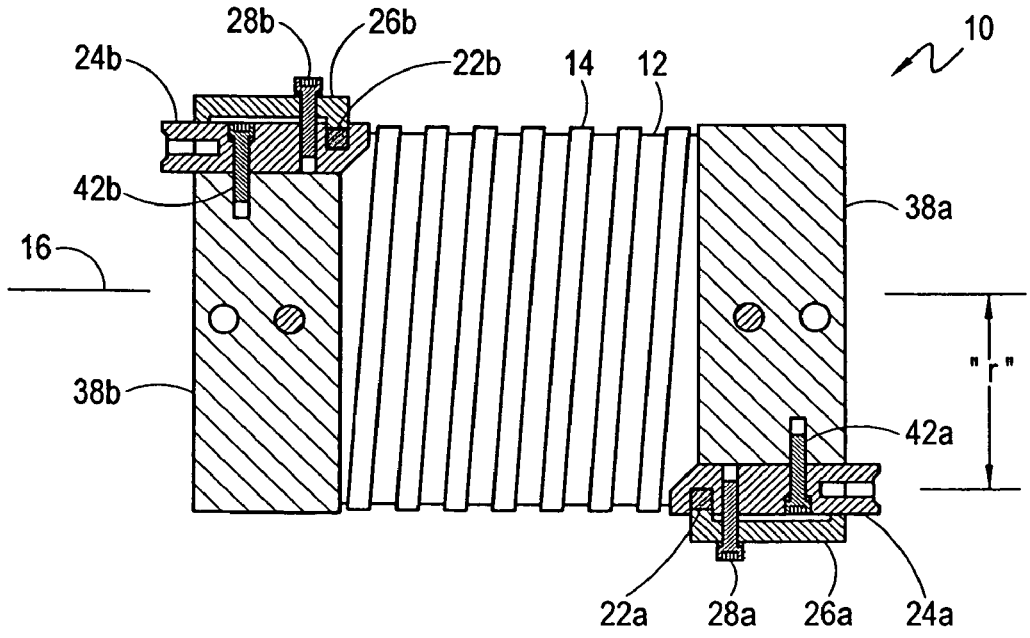
FIG. 4 is a cross-sectional view of an inductor as seen along line 4-4 in FIG. 3.

Turning now to FIGS. 3 and 4, a mechanism is provided to clamp the ends 22*a,b* of the wire coil 14 to the form 12. For the inductor 10 shown, each end 22*a,b* of the wire coil 14 is clamped to a respective conductive terminal 24*a,b*, which is typically made of copper, with stainless steel clamps 26*a,b* and fasteners 28*a,b*. Each conductive terminal 24*a,b* can then be electrically connected to a respective bus bar, such as the bus bar 30 shown in FIG. 5, which electrically connects the inductor 10 to other circuit elements (not shown).

Referring back to FIG. 2, it can be seen that the inductor 10 includes a pair of saddles 32*a,b* that are made of a nonmagnetic material such as stainless steel. As shown, a saddle 32*a,b* is positioned at each end of the form 12. It is further shown that each saddle 32*a,b* includes an inner saddle member 34*a,b* that is located inside the form 12 and positioned against the cylindrical inner surface 36 of the tubular form 12. Continuing with FIG. 2, it can be seen that each saddle 32*a,b* also includes an outer saddle member 38*a,b* that is located outside the form 12 and positioned against the outer surface 18 of the tubular form 12. A pair of high strength stainless steel bolts 40*a,b* is provided with each bolt 40*a,b* extending through the tubular form 12 to attach a respective inner saddle member 34*a,b* to a respective outer saddle member 38*a,b*. As best seen in FIG. 4, each conductive terminal 24*a,b* is then mounted on a respective outer saddle member 38*a,b* using a fastener 42*a,b*.

This structure of the saddles 32*a,b* results in only high strength, nonmagnetic portions of the saddle/clamp system to be located within the tubular form 12 where relatively strong magnetic fields are generated. Specifically, the saddles 32*a,b* allow the conductive terminals 24*a,b* and bus bar 30 to be positioned outside the tubular form 12 where the magnetic field generated by the wire coil 14 is relatively small. In particular, as seen with cross-reference to FIGS. 2 and 4, the tubular form 12 has a cylindrical inner surface 36 that is distanced from the tube axis 16 by a radial distance, "R". In addition, the end 22*a* of the wire coil 14 is clamped between the terminal 24*a* and the clamp 26*a* at a clamping point that is distanced from the tube axis 16 by a radial distance, "r", with "r">"R". Thus, the ends 22*a,b* of the wire coil 14 are clamped at locations where the magnetic field is relatively small (i.e. at locations radially distanced from the axis 16 by distances greater than "r").

Figure 5:
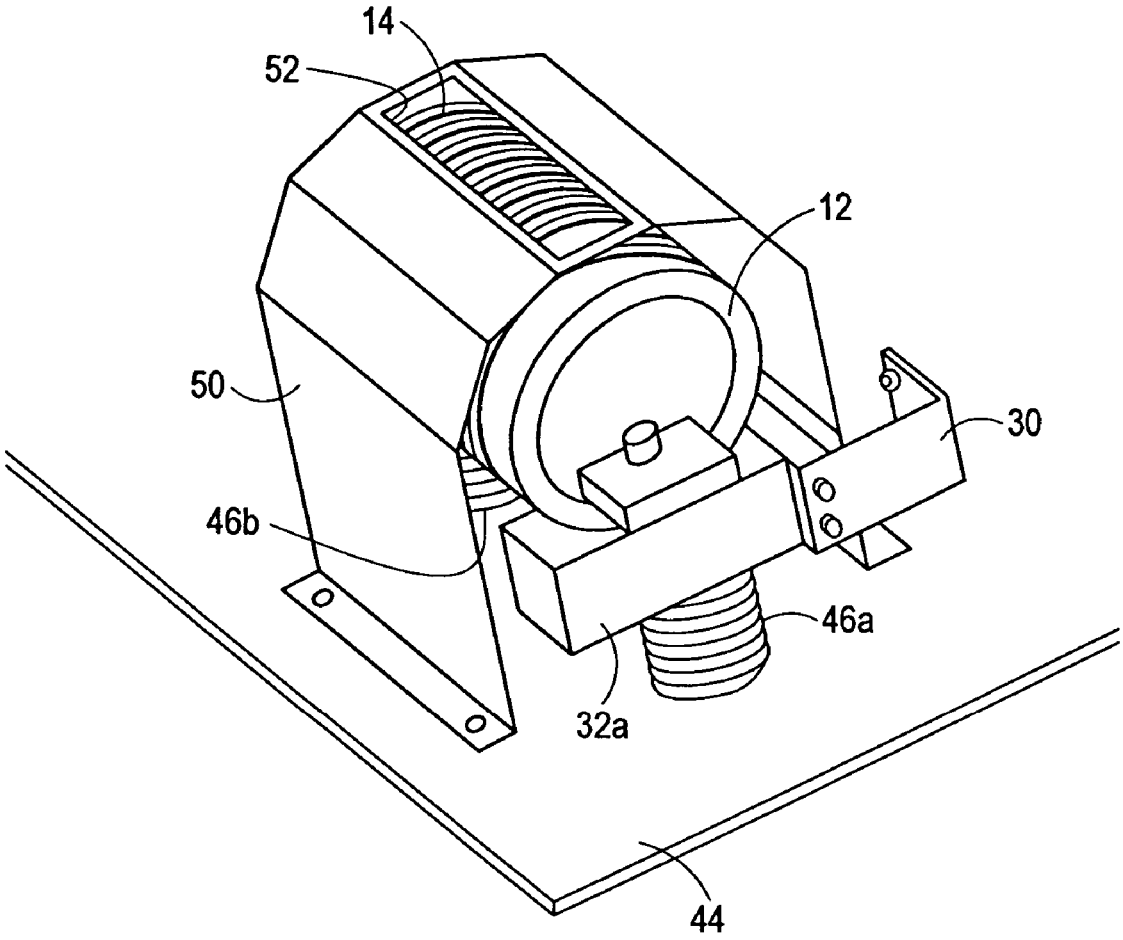
FIG. 5 is a perspective view of an inductor shown mounted on a mounting plate and having a cooling shroud.

FIG. 5 depicts the inductor 10 mounted on a flat mounting plate 44 for connection with various other components (not shown) that can be mounted on the mounting plate 44. As shown in FIG. 2, the inductor 10 includes a pair of insulating members 46*a,b*, with each insulating member 46*a,b* affixed to a respective outer saddle member 38*a,b* by fasteners 48*a,b*. FIG. 5 shows that each insulating member 46*a,b* is then attached to the mounting plate 44. For the arrangement shown in FIG. 5, a shroud 50 formed with a hole 52 is mounted on the mounting plate 44 to partially cover the form 12 and wire coil 14. A fan (not shown) can be positioned below the mounting plate 44 and activated to pass air up through a hole in the mounting plate 44 and through a volume defined by the shroud 50 to cool the partially exposed wire coil 14 and form 12.

While the particular high current, long life inductor as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for manufacturing an inductor, said method comprising the steps of:

providing a nonconductive tube having a first end and a second end, with said tube having an outer surface and defining a tube axis, and with said tube having a cylindrical inner surface distanced from said tube axis by a radial distance, R;

providing a first saddle and a second saddle;

fastening the first end of the tube to the first saddle, with said first saddle abutting the outer surface and the inner surface of the tube;

fastening the second end of the tube to the second saddle, with said second saddle abutting the outer surface and the inner surface of the tube;

mounting a first clamp to the first saddle and a second clamp to the second saddle;

forming a groove in said outer surface, said groove extending substantially helically about said tube axis;

winding a wire extending from a first end to a second end around said tube to create a plurality of turns, with at least a portion of said wire disposed in said groove to maintain said wire in a predetermined shape with a predetermined separation between adjacent turns during a generation of magnetic forces created by electrical currents passing through said wire;

clamping said first end of said wire with the first clamp at a first clamping point distanced from said tube axis by a radial distance, r, with r>R; and clamping said second end of said wire with the second clamp.

2. A method as recited in claim 1 further comprising the steps of:

providing a shroud for establishing a volume;

positioning at least a portion of said wire in said volume; and circulating a fluid in said volume to cool said wire.

3. A method as recited in claim 2 wherein the saddles are made of a non-magnetic material.

4. A method as recited in claim 3 wherein said saddles are made of a stainless steel.

5. A method as recited in claim 3 further comprising the steps of:

affixing an insulating member to each saddle; and attaching said insulating member to a mounting plate.

6. A method as recited in claim 1 wherein the groove is formed with a rectangular cross section and has a first side surface and a second side surface, with said side surfaces extending in a substantially perpendicular direction from the tube axis.

7. A method as recited in claim 6 wherein said wire has a rectangular cross section and includes a proximal edge and a distal edge, and wherein said proximal edge of the wire abuts said first side surface of the groove and said distal edge of the wire abuts said second side surface of the groove.

8. A method for manufacturing an inductor, said method comprising the steps of:

providing a tube having a first end and second end, with said tube having a wall formed with a groove extending partway through said wall, wherein said tube is formed with an outer surface and a cylindrical inner surface defining a tube axis, and wherein said cylindrical inner surface is distanced from said tube axis by a radial distance, R;

providing a first saddle and a second saddle;

fastening the first end of the tube to the first saddle, with said first saddle abutting the outer surface and the inner surface of the tube;

fastening the second end of the tube to the second saddle, with said second saddle abutting the outer surface and the inner surface of the tube;

positioning in said groove a coiled wire formed with a plurality of turns for passing an electrical current therethrough, wherein said wire extends from a first end to a second end, and wherein said wire is disposed in said groove to at least partially expose said wire to a volume surrounding said tube to cool said wire, said groove being dimensioned for holding said wire to maintain a predetermined separation between adjacent turns during a generation of magnetic forces created by electrical currents passing through said wire;

mounting a first clamp to the first saddle and a second clamp to the second saddle;

clamping said first end of said wire with the first clamp at a first clamping point distanced from said tube axis by a radial distance, r, with r>R; and clamping said second end of said wire with the second clamp.

9. A method as recited in claim 8 wherein said tube is made of a nonconductive material.

10. A method as recited in claim 8 further comprising the steps of:

providing a shroud for establishing said volume for surrounding said tube;

positioning at least a portion of said wire in said volume; and circulating a fluid in said volume to cool said wire.

11. A method as recited in claim 8 wherein the saddles are made of a non-magnetic material.

12. A method as recited in claim 11 wherein said saddles are made of a stainless steel.

13. A method as recited in claim 11 further comprising the steps of:

affixing an insulating member to each saddle; and attaching said insulating member to a mounting plate.

14. A method as recited in claim 8 wherein the groove is formed with a rectangular cross section and has a first side surface and a second side surface, with said side surfaces extending in a substantially perpendicular direction from the tube axis.

15. A method as recited in claim 14 wherein said wire has a rectangular cross section and includes a proximal edge and a distal edge, and wherein said proximal edge of the wire abuts said first side surface of the groove and said distal edge of the wire abuts said second side surface of the groove.

* * * * *